US007066572B2

(12) United States Patent
McGarry et al.

(10) Patent No.: US 7,066,572 B2
(45) Date of Patent: Jun. 27, 2006

(54) PRINTING SYSTEM

(75) Inventors: Mark McGarry, San Diego, CA (US); Robert Fogarty, San Diego, CA (US); Josep-Maria Serra, San Diego, CA (US); Ronald D. Stephens, Poway, CA (US); Kurt Thiessen, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 346 days.

(21) Appl. No.: 10/699,893

(22) Filed: Nov. 3, 2003

(65) Prior Publication Data

US 2005/0093922 A1 May 5, 2005

(51) Int. Cl.
*B41J 2/15* (2006.01)
*B41J 2/145* (2006.01)

(52) U.S. Cl. ..... 347/40; 347/85; 347/86

(58) Field of Classification Search ..... None
See application file for complete search history.

(56) References Cited

U.S. PATENT DOCUMENTS

| | | | |
|---|---|---|---|
| 4,422,085 | A | 12/1983 | Sumitomo et al. |
| 4,709,249 | A | 11/1987 | Hanagata |
| 4,970,533 | A | 11/1990 | Saito et al. |
| 5,396,078 | A | 3/1995 | Klaus et al. |
| 5,461,405 | A | 10/1995 | Lehmann et al. |
| 5,835,111 | A | 11/1998 | Balazer |
| 5,877,795 | A | 3/1999 | Gragg et al. |
| 5,880,748 | A | 3/1999 | Childers et al. |
| 5,886,718 | A | 3/1999 | Johnson et al. |
| 5,912,688 | A | 6/1999 | Gragg |
| 5,966,155 | A | 10/1999 | Pawlowski, Jr. et al. |
| 5,971,529 | A | 10/1999 | Pawlowski, Jr. et al. |
| 5,992,975 | A | 11/1999 | Gasvoda et al. |
| 6,003,981 | A | 12/1999 | Cameron et al. |
| 6,024,441 | A | 2/2000 | Nishimoto |
| 6,033,064 | A | 3/2000 | Pawlowski, Jr. et al. |
| 6,068,370 | A | 5/2000 | Miller et al. |
| 6,199,974 | B1 | 3/2001 | Chen |
| 6,206,511 | B1 | 3/2001 | Cook et al. |
| 6,227,651 | B1 | 5/2001 | Watts et al. |
| 6,247,802 | B1 | 6/2001 | Gasso |
| 6,375,308 | B1 | 4/2002 | Shimada |
| 6,536,871 | B1 | 3/2003 | Haddick et al. |
| 6,575,553 | B1 | 6/2003 | Williams et al. |

FOREIGN PATENT DOCUMENTS

| | | | |
|---|---|---|---|
| DE | 197 48 914 | A1 | 8/1998 |
| EP | 1 329 322 | A2 | 7/2003 |
| EP | 1 415 812 | A1 | 5/2004 |
| GB | 2 321 623 | A | 8/1998 |

OTHER PUBLICATIONS

European Search Report for Application No. EP 04 25 6738, mailed Feb. 24, 2005, 3 pages.

*Primary Examiner*—Thinh Nguyen

(57) ABSTRACT

A printing system includes an ink reservoir, a support, a fluid conduit and a printhead assembly. The fluid conduit is fluidly coupled to the ink reservoir and includes a first fluid coupler. The printhead assembly includes a body configured to be releasably coupled to the support, a plurality of printheads coupled to the body including a first printhead and a second printhead, and a fluid passage fluidly coupled to both the first printhead and the second printhead. The fluid passage includes a second fluid coupler releasably coupled to the first fluid coupler.

56 Claims, 4 Drawing Sheets

PRINTING SYSTEM

BACKGROUND

Off-axis printing systems print ink from a remote ink reservoir upon a print medium. Such off-axis printing systems are commonly employed in large scale printing operations in which large volumes of ink are required. The ink is typically delivered from an ink reservoir through an elongate tube to a plurality of printheads individually mounted to either a carriage or a stationary structure adjacent the print medium. With such systems, to change the color of ink or the type of ink being printed upon the medium generally requires that the existing ink within the tube and each of the printheads be flushed out of the system using a solvent or other liquid. Once the existing ink has been removed, the tube and each of the printheads must be initially filled or primed with the new ink prior to printing. This process required for switching between different inks is tedious and difficult. The required downtime of the printing system during the process results in costly printing delays. In addition, the required disposal of the flushing agent can oftentimes be problematic due to cost and environmental concerns.

DETAILED DESCRIPTION OF EXAMPLE EMBODIMENTS

Figure 1:
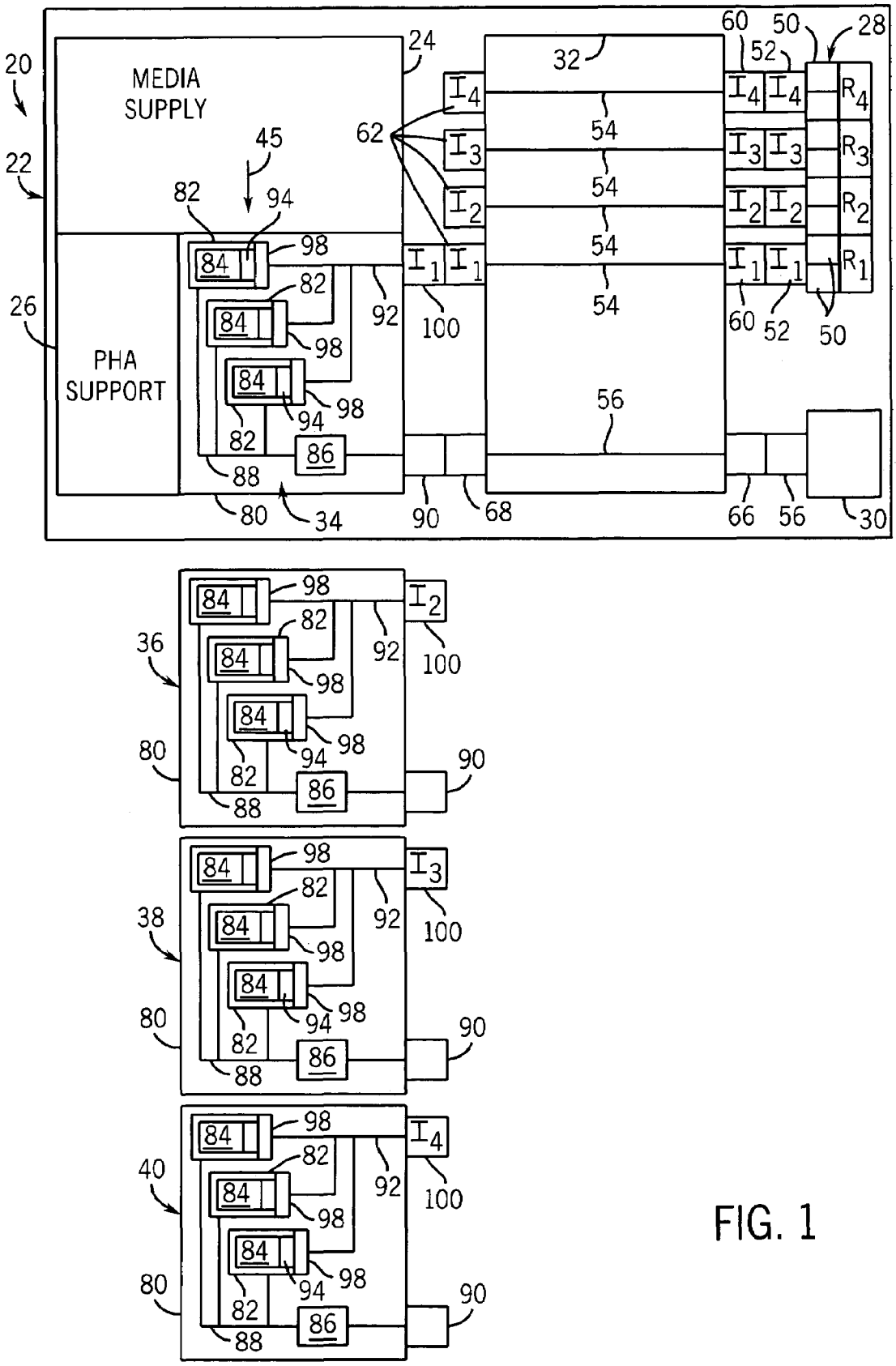
FIG. 1 is a schematic view of one example of a printer kit of the present invention including a printer system having one of a plurality of interchangeable printhead assemblies.

FIG. 1 schematically illustrates printer kit 20 configured for printing different inks upon a print medium. Printer kit 20 generally includes printing system 22, which includes printhead assembly 34, and alternative printhead assemblies 36, 38 and 40. In addition to printhead assembly 34, printing system 22 includes media supply 24, printhead assembly support 26, ink supply system 28, controller 30 and umbilical 32. Media supply 24 comprises a device configured to position a print medium proximate to printhead support 26 and one of printhead assemblies 34, 36, 38, 40 supported by printhead assembly support 26. In one embodiment, media supply 24 moves a print medium relative to a selected printhead assembly 34, 36, 38, 40 in the direction indicated by arrow 45. In alternative embodiments, media supply 24 may only retain or hold the print medium as ink or other fluid is deposited upon the print medium. Media supply 24 may have a variety of different sizes, shapes and configurations depending upon the particular type of print medium being printed upon as well as the exact configuration of printing system 22.

Printhead assembly support 26 comprises a device configured to be releasably coupled to a selected one of printhead assemblies 34, 36, 38, 40 while supporting the selected printhead assembly proximate to the print medium as ink or other fluid is being deposited upon the medium. For purposes of this disclosure, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature.

In one particular embodiment, printhead assembly support 26 may be directly and releasably coupled to a selected one of printhead assemblies 34, 36, 38, 40. In another embodiment, printhead assembly support 26 may be releasably but indirectly coupled to a selected one of printhead assembly 34, 36, 38 and 40. In one embodiment, printhead support 26 may comprise a rigid stationarily supported structure such as a bracket, frame, housing and the like which stationarily supports a selected one of printhead assemblies 34, 36, 38, 40 proximate to the print medium during printing. In another embodiment, printhead assembly support 26 may comprise a structure configured to support a selected one of printhead assemblies 34, 36, 38, 40 proximate to a print medium as the printhead assembly support 26 is itself moved or scanned across the print medium. In such an application, the printhead assembly support may be referred to as a carriage. In one embodiment, the printhead assembly support may be coupled to one of more sides of a printhead assembly 34, 36, 38, 40 or may alternatively be coupled to a selected printhead assembly 34, 36, 38, 40 at a location above or below the selected printhead assembly.

Ink supply system 28 generally comprises a system configured to supply different inks or other printing fluids to the selected printhead assembly 34, 36, 38, 40. The different fluids or inks may have differing chemical compositions which results in the fluids or inks having differing colors or other physical properties. Ink supply system 28 includes four ink reservoirs R1, R2, R3, R4 and a fluid delivery device 50 associated with each ink reservoir R1, R2, R3, R4. Fluid delivery device 50 may comprise a pump configured to pressurize the fluid to move the fluid from an associated ink reservoir towards a selected printhead assembly. Examples of pumps include peristaltic pumps such as those disclosed in co-pending U.S. patent application Ser. No. 10/647,496 entitled "Peristaltic Pump", filed on Aug. 25, 2003 by Jeremy A. Davis, Melissa S. Gedraitis and Kevin D. Koller and co-pending U.S. patent application Ser. No. 10/657,425 entitled "Peristaltic Pump", filed on Sep. 8, 2003 by Timothy M. Souza, the full disclosures of which are hereby incorporated by reference. Alternatively, fluid delivery devices 50 may comprise pumps in which a movable member engages a flexible membrane or bongo to pressurize and move fluid from an ink reservoir. Examples of this type of pump is disclosed in copending U.S. patent application Ser. No. 10/636,925 entitled "Printer Ink Supply System" and filed on Aug. 7, 2003 by Jason S. Ord, Alan Shibata, Justin M. Roman, Timothy A. Longust, Lap T. Nguyen, Laurie L. T. Ramos, David L. Whalen and Robert L. Battey, the full disclosure of which is hereby incorporated by reference. In other alternative embodiments, fluid delivery devices 50 may comprise other devices configured to move fluid.

As further shown in FIG. 1, each reservoir R1, R2, R3, R4 and associated fluid-pumping device includes a fluid coupler 52 fluidly coupled to an associated ink reservoir. For purposes of this disclosure, the terms "fluidly coupled" or "in fluid communication" means that two or more members having fluid containing volumes that are connected to one another by one or more fluid passages enabling fluid to flow between the volumes in one or both directions. Such fluid flow may be temporarily cessated by selective actuation of valve devices. Fluid couplers 52 comprise fluid couplers configured to provide fluid communication with the ink contained within their associated reservoir R1, R2, R3, R4 when releasably connected to an opposite fluid coupler. In the particular embodiment shown, couplers 52, when not connected to an opposite fluid coupler, close off or seal their associated reservoir R1, R2, R3, R4 or any fluid conduit or passage extending between the associated reservoir and the fluid coupler. In alternative embodiments, couplers 52 are not configured to automatically close off or seal their associated reservoir or conduit or passage when disconnected from an opposite fluid coupler. As will be described in greater detail hereafter, each of fluid couplers 52 includes a distinct umbilical connection indicia I2, I2, I3, I4 to ensure proper connection of fluid couplers 52 with an opposite fluid coupler of umbilical 32.

Controller 30 communicates with the selected printhead assembly 34, 36, 38, 40 to control the depositing of ink upon the print medium by the printhead assembly. In particular applications, controller 30 may also communicate with media supply 24, ink supply system 28 and printhead assembly support 26 (such as when printhead assembly support 26 is a movable carriage) to control the supply of print media, to monitor and control the supply of ink from reservoirs R1, R2, R3, R4 and to control the movement of a selected printhead assembly 34, 36, 38, 40 relative to the print medium. Controller 30 comprises a processor unit. For purposes of the disclosure, the term "processor unit" shall include a processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device or some other persistent storage. In other embodiments, hard-wired circuitry may be used in place of or in combination with software instructions to implement the functions described. Controller 30 is not limited to any specific combination of hardware circuitry and software, nor to any particular source for the instructions executed by the processing unit. Controller 30 includes a signal-transmitting connector 55 configured to be connected to an opposite connector for transmitting control signals from controller 30.

Umbilical 32 transmits ink from ink supply system 28 and control signals from controller 30 to a selected one of printhead assemblies 34, 36, 38 and 40. Umbilical 32 is generally formed from a single structure or unit which includes fluid conduits 54 and signal-transmitting line 56. Fluid conduits 54 generally comprise fluid ducts through which fluid may flow. Each conduit 54 corresponds to a particular one of reservoirs R1, R2, R3 and R4. Each conduit 54 includes an ink side fluid coupler 60 and an assembly side fluid coupler 62. Each ink side fluid coupler 60 is configured to be releasably connected to an opposite corresponding fluid coupler 52. Each fluid coupler 60 is further configured to transmit fluid when connected to an opposite fluid coupler 52 and so as to not transmit fluid when disconnected from an opposite fluid coupler 52. In the particular embodiment illustrated, fluid couplers 52 comprise one of a septum and a needle while fluid couplers 60 comprise the other of a septum and a needle. In alternative embodiments, fluid couplers 52 and 60 may comprise other fluid couplers. For example, in alternative embodiments, couplers 62 are not configured to automatically close off or seal their associated reservoir or conduit or passage when disconnected from an opposite fluid coupler.

As further shown by FIG. 1, each fluid coupler 60 includes a distinct ink indicia I1, I2, I3, I4. The indicia I1, I2, I3, I4 suggest or indicate the specific ink fluid coupler 52 that should be connected to the particular ink side fluid coupler 60. Indicia I1, I2, I3, I4 of fluid couplers 52 and indicia I1, I2, I3, I4 of fluid couplers 60 need not necessarily be provided directly upon the fluid coupler. Instead, such indicia may alternatively be provided on a surface or structure adjacent to the associated fluid connector. The indicia I1, I2, I3, I4 of fluid couplers 52 do not necessarily have to match the indicia I1, I2, I3, I4 of corresponding fluid coupler 60 to suggest their connection. For example, indicia I1 of fluid coupler 60 and indicia I1 of fluid coupler 52 may have mating or complementary shapes indicating their relationship to one another.

Such indicia for suggesting or identifying the proper connection to fluid couplers 52 and 60 may include color, surface markings or external configurations. For example, in one embodiment, indicia I1 of couplers 52 and 6Q both have a first color, indicia I2 of couplers 52 and 60 may have a second color, indicia I3 of couplers 52 and 60 may be provided with a third color, while indicia I4 of couplers 52 and 60 may be provided with a fourth color. The entire outer surface of fluid couplers 52 and 60 may be provided with a color or only a portion of fluid couplers 52, 60 or adjacent surfaces may be provided with the color. In one embodiment, the particular color chosen for the indicia associated with a coupler 52 and its corresponding coupler 60 may be chosen so as to be substantially similar to the color of the ink in the associated reservoir to be pumped through the fluid couplers. For example, reservoir R1 may contain cyan ink, wherein indicia I1 of couplers 52 and 60 would also be provided with the color cyan. If reservoir R2 contained magenta ink, indicia I2 of couplers 52 and 60 may be provided with a magenta color.

In still other embodiments, surface markings may be employed to correlate couplers 52 and 60 which should be connected to one another. Such surface markings may include alphanumeric symbols, shapes, labels and the like. Such surface markings may be provided by attaching labels to the fluid couplers or to portions adjacent to the fluid couplers, by etching the markings into the surface or by forming the markings along the surface of the fluid or to surfaces adjacent to the fluid couplers.

In still other embodiments, indicia I1, I2, I3, I4 may comprise external configurations. For example, indicia I1 of couplers 52 and 60 may have a generally cylindrical external shape while indicia I2 of couplers 52 and 60 have a generally rectangular cross sectional shape. Overall, indicia I2-I4 of couplers 52 and indicia I1–I4 of couplers 60 assist in ensuring that fluid couplers 60 are consistently connected to the same fluid couplers 52 and the same ink reservoirs R1–R4 such that the same ink is transmitted through conduits 54.

Assembly side fluid couplers 62 are in fluid communication with an opposite end of conduits 54 and are configured to be releasably connected to a select one of printhead assemblies 34, 36, 38 and 40. Each fluid coupler 62 is configured to fluidly connect a selected printhead assembly 34, 36, 38 and 40 to its associated conduit 54 when connected to an opposite fluid coupler. Each fluid coupler 62 is further configured to occlude flow from its conduit 54 when not connected to an opposite fluid coupler. In alternative embodiments, couplers 62 are not configured to automatically close off or seal their associated reservoir or conduit or passage when disconnected from an opposite fluid coupler.

As further shown by FIG. 1, each assembly side fluid coupler 62 is provided with distinct indicia I1, I2, I3, I4 indicating or suggesting which of printhead assemblies 34, 36, 38, 40 is to be connected using the particular fluid coupler 62. In one embodiment, fluid couplers 62 have indicia I1, I2, I3, I4 identical to indicia I1, I2, I3, I4 of fluid couplers 60. In alternative embodiments, indicia I1, I2, I3, I4 of fluid couplers 62 are distinct from the indicia I1, I2, I3, I4 of fluid couplers 60.

Signal-transmitting line 56 generally comprises one or more communication lines along which signals may be transmitted between controller 30 and the connected printhead assembly 34, 36, 38, 40. The exact configuration of signal-transmitting line 56 may vary depending upon mode or nature of the signals being transmitted such as whether the signals are electrical signals, optical signals or other forms of signals. In the particular embodiment illustrated, signal transmitting line 56 comprises one or more electrically conductive wires or traces connected to a controller side signal-transmitting connector 66 at one end and an assembly side signal-transmitting connector 68 at the other end. Connector 66 is configured to releasably connect to connector 56 so as to transmit control signals from controller 30 through connectors 56 and 66 to line 56. Similarly, connector 68 is configured to be releasably connected to an opposite connector of a selected one of printhead assemblies 34, 36, 38, 40.

Printhead assembly 34 (also known as a "brick") generally comprises an assembly which is movable as a single unit and which is configured to be releasably coupled to printhead assembly support 26 proximate to a print medium. Printhead assembly 34 is also configured to be releasably coupled to umbilical 32 such that printhead assembly 34 may be swapped with printhead assemblies 36, 38, 40 to print different inks or different fluids upon the print medium. In the particular embodiment illustrated, printhead assembly 34 includes body 80, printhead stalls 82, printheads 84, driver 86, signal-transmitting lines 88, signal-transmitting connector 90 and fluid passage 92.

Body 80 generally comprises one or more structures which serve as the base, housing, enclosure or frame for supporting the remaining components of printhead assembly 34 such that printhead assembly 34 may be preassembled, transported, stored and releasably coupled to support 26 as a single unit or member. In one embodiment, body 80 is releasably and directly coupled to printhead assembly support 26 such that printheads 84 are situated proximate to the print medium. In another embodiment, body 80 is releasably but indirectly coupled to support 26. For example, printhead assembly support 26 may support an intermediate structure, such as an end portion of umbilical 32, to which printhead assembly 34 is directly and releasably coupled. The releasable coupling of body 80 to support 26 may be accomplished using any one of a variety of releasable mounting mechanisms or arrangements. In the particular embodiment illustrated, body 80 is configured to be releasably coupled to support 26 without the use of fasteners, enabling body 80 to be quickly and easily coupled to and de-coupled from support 26 without tools. For example, in one application, body 80 includes one or more mating structures such as hooks, pins, flexible tabs and the like which mate with one or more corresponding catches, bores and shoulders, respectively, provided on support 26.

Stalls 82 generally comprise structures coupled to body 80 and configured to physically retain printheads 84 in place relative to body 80. In the particular embodiment illustrated, stalls 82 further serve as signal-transmitting connectors communicatively coupled to driver 86 by signal-transmitting lines 88. In the particular embodiment illustrated, printheads 84 and stalls 82 are supported by body 80 in a staggered relationship to one another. The staggered relationship of printheads 84 provides printhead assembly 34 with a wider print swath. In alternative embodiments, printheads 84 may be positioned in general alignment with one another. Stalls 82 may have various sizes, shapes and configurations depending upon the exact configuration of body 80 and that of printheads 84.

Printheads 84 (also known as pens or cartridges) comprise printheads having nozzles for dispensing a fluid such as ink upon the print medium. Each printhead 84 includes a fluid coupler 94 fluidly coupled to the individual nozzles of the printhead. Fluid coupler 94 fluidly connects printhead 84 to fluid passage 92 when connected to an opposite fluid coupler of fluid passage 92. In the particular embodiment illustrated, fluid coupler 94 is configured to prevent the outflow of fluid from printhead 84 when coupler 94 is disconnected from an opposite fluid coupler.

Driver 86 comprises a processor unit configured to generate control signals which are transmitted to printheads 84 by signal-transmitting lines 88 to control the operation of printheads 84. In the particular embodiment illustrated, driver 86 includes a printed, circuit assembly supported by body 80 and generates electrical control signals which are transmitted to printheads 84 through an electrically conductive wire or trace constituting line 88. Driver 86 receives control signals from controller 30 through signal-transmitting connector 90. In alternative embodiments where control signals from controller 30 are transmitted directly to printheads 84, driver 86 may be omitted.

Signal-transmitting connector 90 is coupled to body 80 and is configured to connect to signal-transmitting connector 68 of umbilical 32. The exact configuration of connector 68 may vary depending upon the configuration of connector 68 as well as the mode or form of the signals being transmitted (e.g., optical, electrical, etc.).

Figure 2:
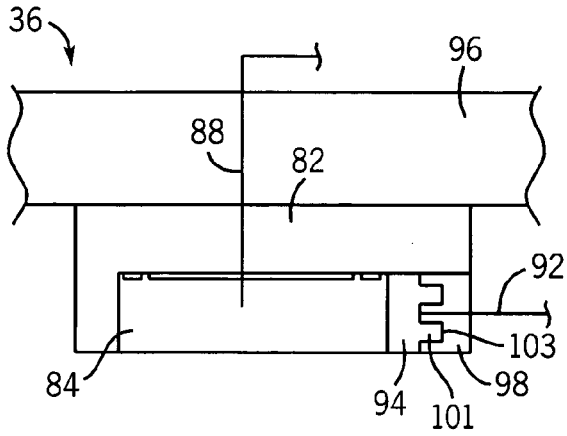
FIG. 2 is an enlarged fragmentary view of a printhead assembly of the printer kit of FIG. 1.

Fluid passage 92 generally comprises a fluid duct in fluid communication with each of printheads 84 and with one of reservoirs R1, R2, R3, R4. Fluid passage 92 includes fluid couplers 98 at one end and fluid coupler 100 at another end. Fluid coupler 98 comprises a structure configured to fluidly connect passage 92 to a printhead 84. Fluid coupler 98 is configured to be releasably coupled to an opposite fluid coupler 94 to provide fluid communication between printhead 84 and passage 92. As schematically shown in FIG. 2, fluid couplers 94 and 98 are keyed to one another by a shape, inter-engaging structures, such as pins 101 and apertures 103, to prevent accidental connection of undesirable printheads 84 to the particular printhead assembly 34. In alternative embodiments, such keying may be omitted. In the particular embodiment illustrated, one of fluid couplers 94, 98 comprises a septum, while the other of fluid couplers 94, 98 comprises a needle. In other embodiments, fluid couplers 94 and 98 may comprise other connection devices that provide for fluid communication through the connection devices.

Fluid coupler 100 is in fluid communication with fluid passage 92 and is generally configured to be releasably connected to at least one of assembly side fluid couplers 62 of umbilical 32. In the particular embodiment illustrated, fluid coupler 100 is configured to provide fluid communication between one of conduits 54 and passage 92 when connected to an opposite fluid coupler 62 and to also seal or occlude fluid passage 92 when not connected to an opposite fluid coupler. In the particular embodiment illustrated, fluid coupler 100 includes one of a septum and a needle while fluid coupler 62 includes the other of a septum and a needle. In alternative embodiments, fluid coupler 100 and fluid coupler 62 may have other fluid coupling mechanisms. In alternative embodiments, couplers 100 are not configured to automatically close off or seal their associated reservoir or conduit or passage when disconnected from an opposite fluid coupler. The exact configuration of such fluid coupling mechanisms may vary depending upon the configuration of umbilical 32, the configuration of printhead assembly 34 and the rate at which fluid is being provided through couplers 100 and 62.

As further shown by FIG. 1, fluid coupler 100 has an associated indicia I1. Indicia I1 may be directly upon fluid coupler 100 or it may be provided on a surface adjacent to fluid coupler 100. Printhead assembly indicia I1 is configured to identify which of fluid couplers 62 of umbilical 32 should be connected to printhead assembly 34 based upon the type of ink or other fluid currently within printhead assembly 34 and within the fluid conduit 54 fluidly connected to the particular fluid coupler 62 or the fluid intended to be provided through the particular conduit 54 and printhead assembly 34. As a result, the indicia of fluid coupler 100 prevents printhead assembly 34 from being fluidly connected to a fluid coupler 62 and a corresponding ink reservoir R1, R2, R3, R4 providing a different ink.

Indicia I1, I2, I3, I4 of fluid couplers 62 and indicia I1, I2, I3, I4 of fluid couplers 100 of assemblies 34, 36, 38 and 40, respectively, need not necessarily be provided directly upon the fluid coupler. Instead, such indicia may alternatively be provided on a surface or structure adjacent to the associated fluid connector. The indicia I1, I2, I3, I4 of fluid couplers 62 do not necessarily have to match the indicia I1, I2, I3, I4 of corresponding fluid coupler 100 of assemblies 34, 36, 38 and 40, respectively, to suggest their connection. For example, indicia I1 of fluid coupler 62 and indicia I1 of fluid coupler 100 may have mating or complementary shapes indicating their relationship to one another.

Such indicia for suggesting or identifying the proper connection to fluid couplers 62 and 100 may include color, surface markings or external configurations. For example, in one embodiment, indicia I1 of couplers 62 and 100 both have a first color, indicia I2 of couplers 62 and 100 may have a second color, indicia I3 of couplers 62 and 100 may be provided with a third color, while indicia I4 of couplers 62 and 100 may be provided with a fourth color. The entire outer surface of fluid couplers 62 and 100 may be provided with a color or only a portion of fluid couplers 62, 100 or adjacent surfaces may be provided with the color. In one embodiment, the particular color chosen for the indicia associated with a coupler 62 and its corresponding coupler 100 may be chosen so as to be substantially similar to the color of the ink in the associated reservoir to be pumped through the fluid couplers. For example, reservoir R1 may contain cyan ink, wherein indicia I1 of couplers 62 and 100 would also be provided with the color cyan. If reservoir R2 contained magenta ink, indicia I2 of couplers 62 and 100 may be provided with a magenta color.

In still other embodiments, surface markings may be employed to correlate couplers 62 and 100 which should be connected to one another. Such surface markings may include alphanumeric symbols, shapes, labels and the like. Such surface markings may be provided by attaching labels to the fluid couplers or to portions adjacent to the fluid couplers, by etching the markings into the surface or by forming the markings along the surface of the fluid or to surfaces adjacent to the fluid couplers.

In still other embodiments, indicia I1, I2, I3, I4 may comprise external configurations. For example, indicia I1 of couplers 62 and 100 may have a generally cylindrical external shape while indicia I2 of couplers 62 and 100 have a generally rectangular cross sectional shape. Overall, indicia I2–I4 of couplers 62 and indicia I1–I4 of couplers 100 assist in ensuring that fluid couplers 60 are consistently connected to the same fluid couplers 62 and the same ink reservoirs R1–R4 such that the same ink is transmitted through conduits 54.

Printhead assembly 36 is substantially identical to printhead assembly 34 except that fluid coupler 100 of printhead assembly 36 is provided with indicia I2 which is distinct from indicia I1. Indicia I2 specifically indicates that printhead assembly 36 is to be used for applying ink from reservoir R2. In particular, indicia I2 indicates that fluid coupler 100 is to be releasably coupled to fluid coupler 62 having indicia I2 and fluidly coupled to ink reservoir R2.

Printhead assembly 38 is substantially identical to printhead assembly 34 except that fluid coupler 100 of printhead assembly 38 is provided with indicia I3 which is distinct from indicia I1. Indicia I3 specifically indicates that printhead assembly 38 is to be used for applying ink from reservoir R3. In particular, indicia I3 indicates that fluid coupler 100 is to be releasably coupled to fluid coupler 62 having indicia I3 and fluidly coupled to ink reservoir R3.

Printhead assembly 40 is substantially identical to printhead assembly 34 except that fluid coupler 100 of printhead assembly 40 is provided with indicia I4 which is distinct from indicia I1. Indicia I4 specifically indicates that printhead assembly 40 is to be used for applying ink from reservoir R4. In particular, indicia I4 indicates that fluid coupler 100 is to be releasably coupled to fluid coupler 62 having indicia I4 and fluidly coupled to ink reservoir R4.

Figure 3:
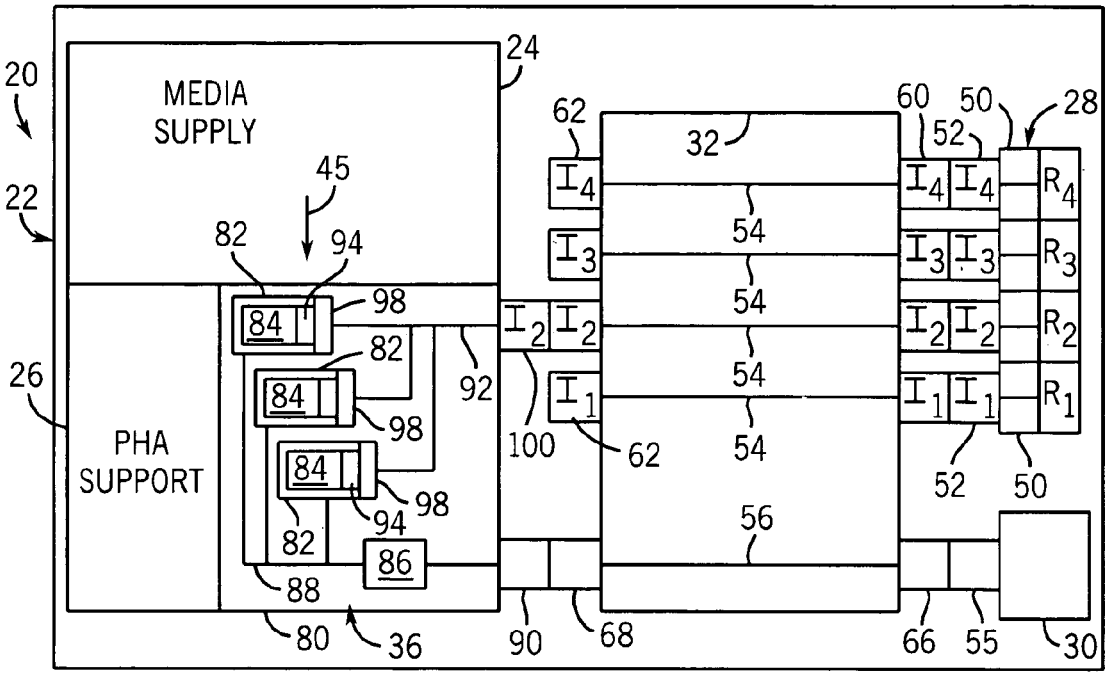
FIG. 3 is a schematic view of the printing system of FIG. 1 having an alternative printhead assembly.

FIGS. 1 and 3 illustrate the modification of printing system 22 to print a different ink upon the print medium. When printer system 22 is in the particular setup shown in FIG. 1, a first ink contained in reservoir R1 is transmitted through fluid couplers 52 and 60 having indicia I1, through conduit 54, through couplers 62 and 100 having indicia I1 and to each of printheads 84. The depositing of the ink upon the print medium is controlled by driver 86 which receives control signals from controller 30 through connectors 56, 66, through signal-transmitting line 56 and through connectors 68 and 90.

FIG. 3 illustrates printer system 22 modified to print a different ink upon the printing medium. In particular, fluid coupler 100 is disconnected from fluid coupler 62, signal-transmitting connector 90 is disconnected from signal-transmitting connector 68 and body 80 is decoupled from support 26. As previously noted, fluid couplers 100 and 62 automatically occlude or seal fluid passages 92 and the associated fluid conduit 54, respectively, upon being disconnected. As a result, the ink contained within the fluid conduit 54 having the fluid coupler 62 with indicia I1 remains within the fluid conduit such that the fluid conduit 54 is primed with ink and ready when ink from reservoir R1 again is to be later printed upon the print medium. Likewise, ink within passage 92 remains within passage 92 such that passage 92 is primed and ready for later use when ink from reservoir R1 is to be printed upon the print medium. The indicia I1 associated with fluid coupler 100 prevents printhead assembly 34 from being later coupled to support 26 with fluid coupler 100 being accidentally coupled to a fluid coupler 62 in fluid communication with an alternative reservoir R2, R3 or R4.

Once printhead assembly 34 is decoupled from support 26, an alternative printhead assembly, such as printhead assembly 36, may be swapped and coupled to support 26 in place of printhead assembly 34. Indicia I2 associated with fluid coupler 100 of printhead assembly 36 indicates that the fluid coupler 100 of printhead assembly 36 should be releasably coupled to fluid coupler 62 having corresponding indicia I2 and fluidly coupled to ink reservoir R2. Once fluid coupler 100 having indicia I1 is connected to fluid coupler 62 having indicia I1 and signal-transmitting connector 90 and is releasably connected to signal-transmitting connector 68, ink from reservoir R2 may be supplied through umbilical 32 to printheads 84 of printhead assembly 36 for printing upon the print media. In a similar manner, printhead assemblies 38 and 40 may be swapped with printhead assembly 36 to print ink from reservoirs R3 and R4, respectively, upon the print medium.

Overall, printer kit and printing system 22 facilitate faster, simpler and less costly switch over from one ink to another ink. In contrast to prior systems which generally require that the entire fluid duct extending from the ink reservoir to the printhead be flushed with a solvent or other cleaning fluid prior to supplying a different ink through the same duct system, kit 20 enables easy switch over to another ink by simply decoupling a first printhead assembly 34 dedicated to printing ink from reservoir R1 from support 26, coupling a second printhead assembly 36 dedicated to printing ink from a reservoir R2 in its place, and connecting fluid coupler 100 having indicia I2 to fluid coupler 62 having the corresponding indicia I2. As a result, this procedure is less time consuming, less costly and less harmful to the environment in that it does not require the disposal of ink and solvents. Similar operations can be easily performed to print with ink from reservoirs R3 and R4 without having to flush existing ink from any of conduits 54.

In contrast to previous systems which additionally require that the fluid duct system flushed of the former ink be then primed with the new ink before printing, printing kit 20 enables printhead assemblies 34, 36, 38, 40 to be pre-primed with a particular ink even before being coupled to support 26. Such pre-priming of printhead assembly 34, 36, 38, 40 may be achieved as part of the manufacture of printhead assemblies 34, 36, 38, 40 or may be the result of the printhead assemblies 34, 36, 38, 40 being previously used and already primed from an earlier printing project using the desired ink. Similarly, each of conduits 54 of umbilical 32 may be pre-primed with different inks prior to being connected to any printhead assembly 34, 36, 38, 40. Such pre-priming of conduits 54 may be achieved as part of the manufacture of umbilical 32 or as a result of the particular conduit 54 being previously used to print the particular ink upon a print medium. In addition, print system 22 enables those conduits 54 not fluidly coupled to any printhead assembly to be filled or primed with different inks as ink is being supplied through the one fluid conduit 54 that is fluidly coupled to a printhead assembly.

Umbilical 32 further simplifies the printing of different inks upon the print medium. Because umbilical 32 includes each of fluid conduits 54 which are configured to be releasably coupled to a selected printhead assembly 34, 36, 38, 40 as well as reservoirs R1, R2, R3, R4 of ink supply 28, umbilical 32 may be easily removed from system 22 for service, repair or replacement. Umbilical 32 may also be removed from system 22 to enable each of conduits 54 to be primed. In particular applications, umbilical 32 may be removed from system 22 to flush one or more of conduits 54 of their existing ink when ink supply 28 is modified to include a different ink in one of its reservoirs. In such circumstances, umbilical 32 may alternatively be swapped with an alternative umbilical 32 having one or more empty conduits 54 or an alternative umbilical 32 that is pre-primed with a set of inks corresponding to the set of inks contained within the new set of ink reservoirs of ink supply system 28. Consequently, umbilical 32 facilitates the use of different ink supply systems 28 containing different sets or combinations of ink within its reservoirs R1, R2, R3, R4.

Because umbilical 32 houses all of conduits 54 and signal transmission line 56 as part of a single unit, umbilical 32 rids printing system 22 of the multiple tubes and cabling often found in typical printing systems. Umbilical 32 enables each of fluid conduits 54 and signal transmission line 56 to be stored, transported and assembled together. Umbilical 32 eliminates tangling of conduits 54 and facilitates easy incorporation into printer system 22 by merely requiring connection of connector 68 and one of couplers 62 to connector 90 and coupler 100 of the selected printhead assembly and by also merely requiring connection of fluid couplers 60 and connector 66 to ink supply 28 and controller 30.

Printer kit 20 and printing system 22 incorporates several beneficial features in a synergistic manner. In alternative embodiments, particular features may be used independent of other features. For example, in one embodiment, fluid couplers 52 and 60 may be omitted, wherein fluid conduits 54 are in direct permanent fluid connection with ink supply system 28. Connectors 56 and 66 may be omitted where signal transmission line 56 is directly and permanently connected to controller 30. Although umbilical 32 may, in some embodiments, have a flexible sheath or body which interconnects each of fluid couplers 54 and signal transmission line 56 to enable umbilical 32 to be easily bent and manipulated during connection with a selected printhead assembly, umbilical 32 may alternatively have a unbending or relatively rigid body. In still other embodiments, umbilical 32 may have a sheath or body interconnecting only fluid couplers 54 while signal transmission line 56 is provided in a separate cable. In still other embodiments, umbilical 32 may be replaced with a plurality of separate umbilicals wherein each umbilical has one or more fluid conduit 54 and the associated fluid couplers on either end.

Figure 4:
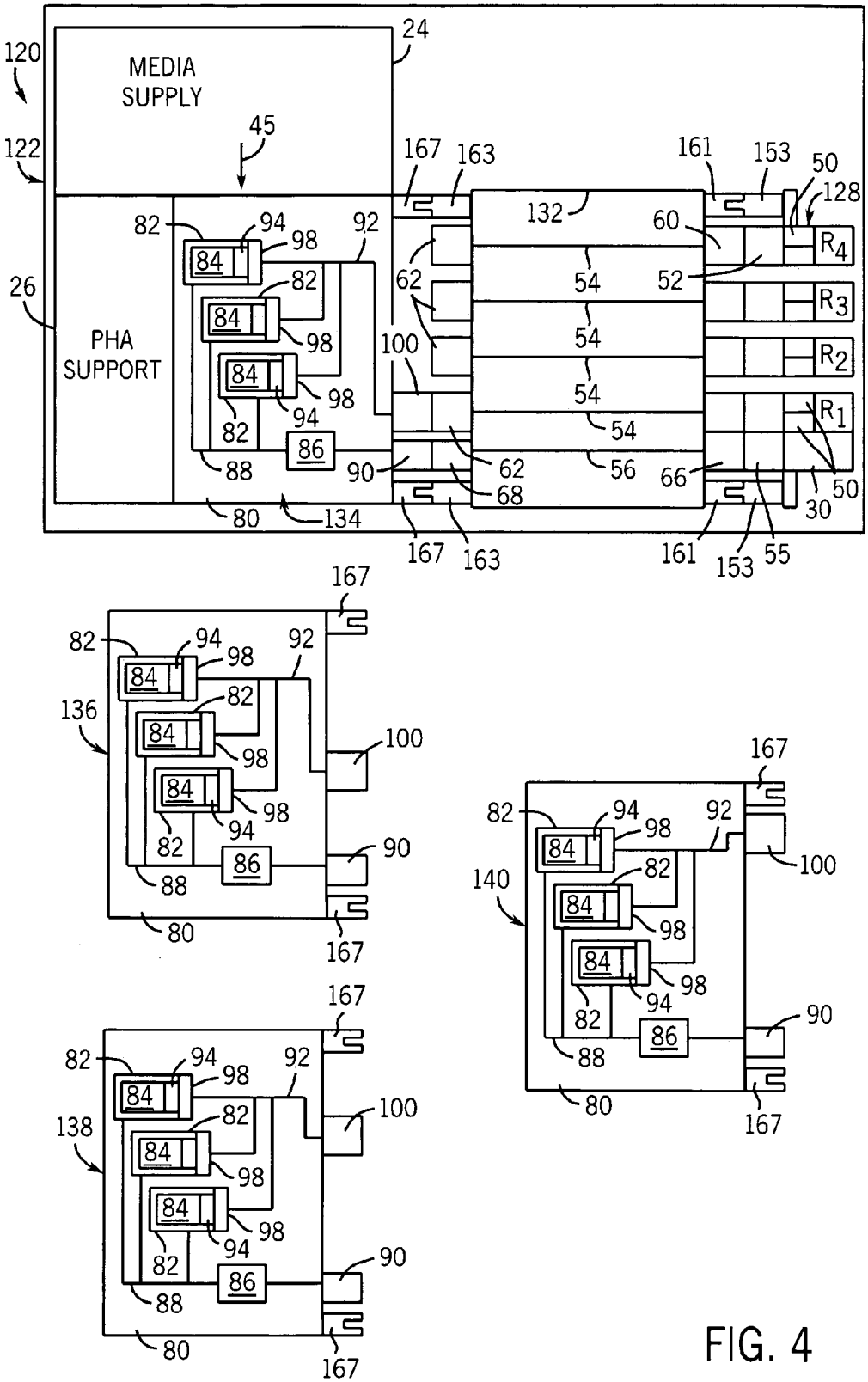
FIG. 4 is a schematic illustration of an alternative embodiment of the printer kit of FIG. 1.

FIG. 4 schematically illustrates printer kit 120, a first alternative embodiment of printer kit 20 shown in FIGS. 1–3. Printer kit 120 generally includes printing system 122 having printhead assembly 134 and alternative printhead assemblies 136, 138, 140. Printing system 122 is similar to printing system 22 except that printing system 122 includes ink supply system 128 in lieu of ink supply system 28 and includes umbilical 132 in lieu of umbilical 32. Those remaining components of printing system 122 which correspond to components of printing system 22 are numbered similarly. Ink supply system 128 is similar to ink supply system 28 except that ink supply system 128 additionally includes ink supply interface 153. Ink supply interface 153 generally comprises a structure coupled to ink supply system 128 proximate to fluid couplers 52. Interface 153 is configured to mate with a corresponding interface of umbilical 132.

Umbilical 132 is similar to umbilical 32 except that umbilical 132 additionally includes input interface 161 and output interface 163. Input interface 161 comprises a structure coupled to umbilical 32 proximate to fluid couplers 60. Interface 161 is configured to cooperatively engage or mate with interface 153 so as to position and align fluid couplers 60 to fluid couplers 52. In the embodiment illustrated, interfaces 161 and 163 are configured so as to be keyed to one another such that interfaces 161 and 153 can only be fully connected to one another when oriented in a single predetermined relationship. In one embodiment, one or both of interfaces 161 and 153 may comprise a manifold incorporating fluid couplers 60 and 52, respectively.

Interface 163 generally comprises one or more structures coupled to umbilical 32 proximate to fluid couplers 62 and configured to cooperatively engage, mate, nest or key with an opposite interface associated with a selected printhead assembly 134, 136, 138, 140 coupled to support 26. In one particular embodiment, interface 163 comprises a rigid manifold incorporating fluid couplers 62. Interface 163 additionally extends proximate to signal-transmitting connector 68. In one embodiment, interface 163 comprises a manifold which also incorporates connector 68 in addition to couplers 62.

Printhead assemblies 134, 136, 138, 140 are each substantially identical to printhead assemblies 34, 36, 38 and 40, respectively, except that printhead assemblies 134, 136, 138, 140 each additionally include interface 167. Interface 167 generally comprises one or more structures coupled to body 80 proximate to fluid coupler 100. Each interface 167 is configured to cooperatively engage or mate with interface 163 of umbilical 132 so as to automatically align fluid coupler 100 of the particular printhead assembly 134, 136, 138, 140 with the corresponding and appropriate fluid coupler 62 of umbilical 32. In particular, interface 167 is keyed to interface 163 during their connection which prevents interface 167 from being connected to interface 163 in an inappropriate orientation. When interface 167 is properly mated to interface 163, fluid coupler 100 is automatically aligned with and in fluid connection with a predetermined one of fluid couplers 61.

In the particular embodiment illustrated, fluid coupler 100 of printhead assembly 134 is automatically brought into alignment with fluid coupler 62 in fluid communication with reservoir R1. Interface 167 and fluid coupler 100 of printhead assembly 136 are configured such that engagement of interface 167 with interface interface 163 automatically aligns fluid coupler 100 with the fluid coupler 62 that is in fluid communication with reservoir R2. Interface 167 and fluid coupler 100 of printhead assembly 138 are configured such that engagement of interface 167 with interface 163 automatically aligns fluid coupler 100 with the fluid coupler 62 that is in fluid communication with reservoir R3. Interface 167 and fluid coupler 100 of printhead assembly 140 are configured such that engagement of interface 167 with interface 163 automatically aligns fluid coupler 100 with the fluid coupler 62 that is in fluid communication with reservoir R4.

Although fluid coupler 100 and the opposite fluid coupler 62 connected to it are illustrated as abutting one another, fluid coupler 100 and the opposite fluid coupler 62 may alternatively mate with one another or may be configured such that one of coupler 100 and coupler 62 is nested or at least partially received within the other of coupler 100 and coupler 62 interconnected. In one particular embodiment, interface 167 comprises a manifold incorporating fluid coupler 100. In still another embodiment of printer kit 120, each printhead assembly 134, 136, 138, 140 may include a fluid coupler 100 corresponding to each ink reservoir of ink supply 28, wherein fluid passage 92 is fluidly coupled to only one of the fluid couplers 100 depending upon the selected ink for which the printhead assembly is dedicated. For example, in the embodiment illustrated, printhead assemblies 134, 136, 138 and 140 may each include four fluid couplers 100 responding to ink reservoirs R1, R2, R3 and R4. However, fluid passage 92 would only be connected to the particular fluid coupler 100 that is automatically aligned with fluid coupler 62 of umbilical 132 in fluid communication with reservoir R1. Fluid passage 92 of printhead assembly 136 would only be fluidly coupled to the particular fluid coupler 100 which is automatically aligned with the fluid coupler 62 of umbilical 132 that is in fluid communication with reservoir R2. In a similar manner, fluid passage 92 of printhead assemblies 138 and 140 would only be fluidly coupled to a fluid coupler 100 configured to be aligned with a fluid coupler 62 that is in fluid communication with reservoirs R3 and R4, respectively. In particular embodiments where interface 167 comprises a manifold incorporating fluid couplers 100, this embodiment would facilitate the use of a single common interface 167 for all of printhead assemblies 134, 136, 138 and 140.

As further shown by FIG. 4, interface 167 is additionally coupled proximate to signal-transmitting connector 90. When connected to interface 163, interface 167 automatically aligns connector 90 with connector 68 of umbilical 32. In alternative embodiments, each of printhead assemblies 134, 136, 138, 140 may include a separate interface for aligning connectors 68 and 90. Alternatively, interfaces proximate to connectors 68 and 90 may be omitted, wherein interfaces 167 and 163 merely align fluid couplers 62 with one or more of fluid couplers 100.

Figure 5:
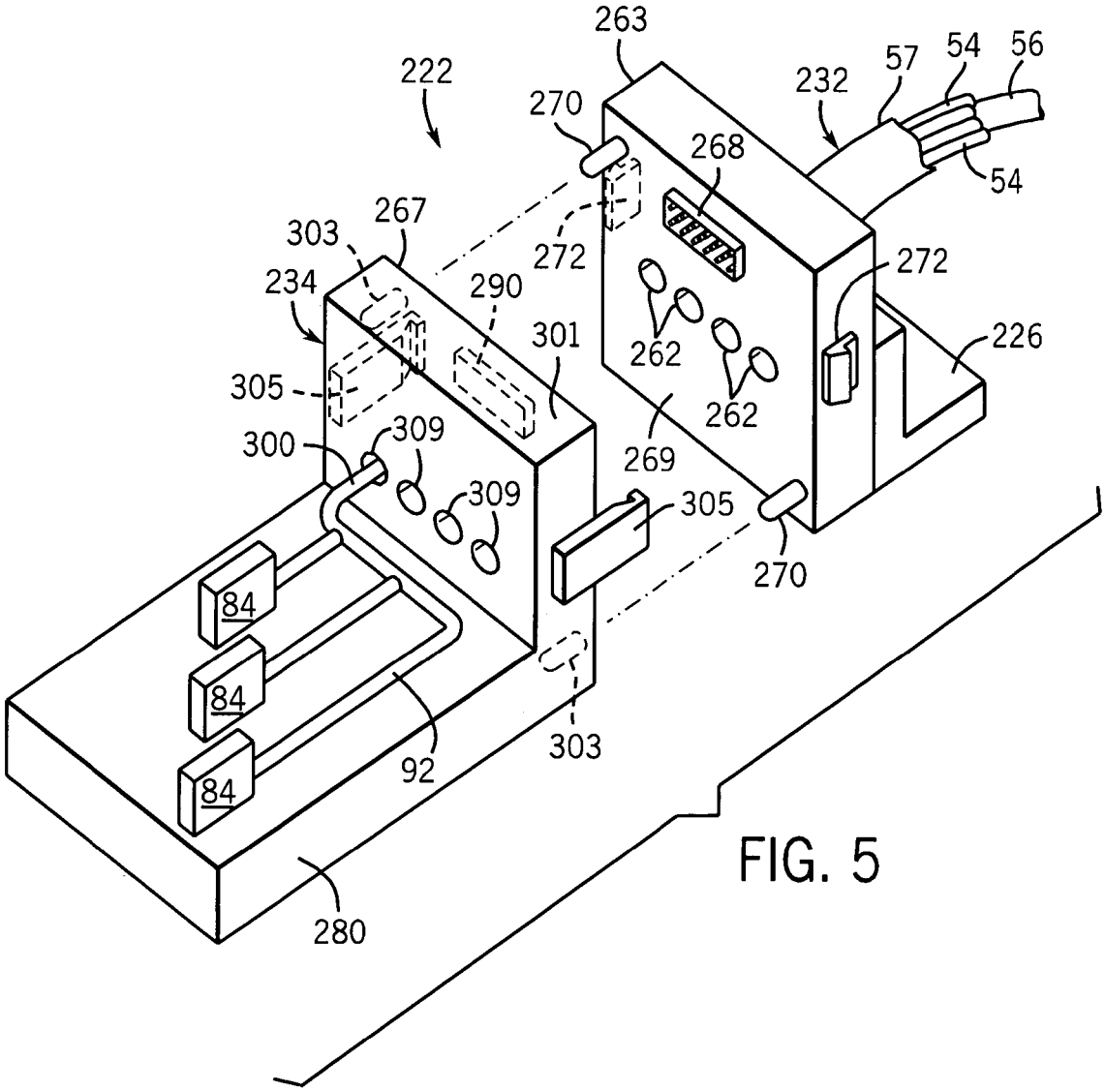
FIG. 5 is a fragmentary perspective view of an alternative embodiment of the printing system of FIG. 1.

FIG. 5 illustrates printing system 222, a second alternative embodiment of printing system 22. Printing system 222 is similar to printing system 22 except that printing system 222 includes printhead assembly support 226, umbilical 232 and printhead assembly 234 in lieu of support 26, umbilical 32 and printhead assembly 34. Printhead assembly support 226 generally comprises a bracket fixed to the frame, housing or other enclosing structure of the printer. Support 226 is configured to extend proximate to a print medium being printed upon and to also support printhead assembly 234 relative to the print medium being printed upon. As shown by FIG. 5, support 226 also supports umbilical 232 and is indirectly coupled to printhead assembly 234 with an intermediate portion of umbilical 232.

Umbilical 232 is releasably mounted to support 226 and extends into connection with ink supply 28 (shown and described with respect to FIG. 11). Umbilical 232 includes fluid conduits 54, signal-transmitting line 56, wrap or sheath 57, fluid couplers 262, interface 263 and signal-transmitting connector 268. Fluid conduits 54 are described with respect to FIG. 1 and generally terminate in fluid connection with fluid couplers 262. Fluid couplers 262 are configured to fluidly couple their respective fluid conduits 54 to printhead assembly 234 when connected to a fluid coupler associated with printhead assembly 234. At the same time, fluid couplers 262 are configured to close or seal off the respective fluid conduit 54 when not connected to an opposite fluid coupler associated with printhead assembly 234. In the particular embodiment illustrated, each fluid coupler 262 comprises a septum. In alternative embodiments, fluid couplers 262 may comprise other stopper, valve or fluid coupling devices that achieve the noted functions.

Signal-transmitting line 56 is described above with respect to FIG. 1 and terminates at signal-transmitting connector 268. Connector 268 is configured to transmit signals from controller 30 (shown in FIG. 1) to printhead assembly 234. In the particular embodiment illustrated, line 56 and connector 268 are both configured to transmit electrical signals. Connector 268 comprises a female EE bulkhead connector. In alternative embodiments, connector 268 may have other configurations depending upon the form of signals being transmitted from controller 30.

Sheath 57 wraps about and surrounds all of fluid conduits 54 to bundle conduits 54. As a result, conduits 54 are less likely to become tangled with one another or other surrounding structures, are less likely to be damaged and are easily inventoried, transported and assembled as a single unit. In the particular embodiment illustrated, sheath 57 additionally bundles line 56 with conduits 54 for enhanced convenience.

Interface 263 generally comprises a structure, such as a mounting bracket, coupled to an end of umbilical 232 so as to support fluid couplers 262 and connector 268. In the particular embodiments illustrated, interface 263 includes internal passages and cavities in which couplers 262 and connector 268 are supported and through which conduits 54 and line 56 extend.

Interface 263 facilitates the releasable connection of one of fluid couplers 262 to printhead assembly 234 and the releasable connection of connector 268 to an opposite signal-transmitting connector associated with printhead assembly 234. In addition, interface 263 is configured to cooperatively engage printhead assembly 234 so as to align one of fluid couplers 262 with an appropriate fluid coupler of printhead assembly 234 and to also align connector 268 with an opposite connector of printhead assembly 234. In the embodiment illustrated, interface 263 includes locating pins 270 and catches or hooks 272. Locating pins 270 comprise projections configured to be received within corresponding bores or apertures of printhead assembly 234. Pins 270 facilitate precise alignment of interface 263 with printhead assembly 234 to align at least one of fluid couplers 262 with an opposite fluid coupler associated with printhead assembly 234.

Hooks 272 extend outwardly from main body 269 and are configured so as to cooperate with corresponding structures associated with printhead assembly 234 to releasably retain interface 263 relative to printhead assembly 234. In alternative embodiments, hooks 272 may alternatively be directly coupled to support 226, wherein printhead assembly 234 engages hooks 272 on support 226 with interface 263 sandwiched between support 226' and printhead assembly 234.

Printhead assembly 234 is configured to print or deposit ink supplied through one of conduits 54 upon an adjacent print medium. Printhead assembly 234 includes body 280, printheads 84, fluid passage 92, fluid coupler 300 and interface 267. Body 280 generally comprises a structure configured to support printheads 84 relative to a print medium. In the particular embodiment illustrated, body 280 is integrally formed as part of a single unitary body with interface 267. In alternative embodiments, body 280 may be mounted to interface 267.

Printheads 84 and fluid passage 92 are described above with respect to FIG. 1. Printheads 84 extend through body 280 such that their nozzles are positioned proximate to the media to be printed upon. In the particular embodiment illustrated, fluid passages 92 comprise ink tubing in fluid connection with printheads 84 and fluid coupler 300. In alternative embodiments, fluid passages 92 may be formed within body 280.

Fluid coupler 300 generally comprises a device configured to be fluidly connected to one of fluid couplers 262 of umbilical 232. Fluid coupler 300 is specifically configured to fluidly communicate with one of fluid conduits 54 when connected to fluid coupler 262 and to close or seal off fluid passages 92 when not connected to one of fluid couplers 262. In the particular embodiments illustrated, fluid coupler 300 comprises a needle having an interior in fluid communication with fluid passages 92 and configured to pass through the septum provided by one of couplers 262. In alternatively embodiments, fluid couplers 262 may comprise needles while fluid coupler 300 comprises a septum. In alternative embodiments, fluid coupler 300 may have other configurations depending upon the configuration of fluid couplers 262.

Interface 267 comprises one or more structures coupled to body 280 and configured to cooperatively interact with interface 263 so as to align fluid coupler 300 with a selected one of fluid couplers 262. Interface 267 is also configured to align signal transmission connector 290 with signal-transmitting connector 268 when connected to interface 263. In the particular, embodiment illustrated, interface 267 includes main body 301, bores or holes 303 and clamps or prongs 305. Body 301 comprises a framework or other structure supporting or providing holes 303 and prongs 305. Although body 301 is illustrated as a generally rectangular block, body 301 may have any of a variety of different sizes, shapes and configurations. For example, in the particular embodiment illustrated, body 301 is generally configured to abut body 269 when interfaces 267 and 263 are connected. In alternative embodiments, one of body 269, 301 may be nested within the other of body 269 and 301 during such connection.

Holes 303 extend into body 301 and are configured to receive locating pins 270 of interface 263. In this manner, fluid coupler 300 is aligned with a selected one of fluid couplers 262. In alternative embodiments, other means may be employed to provide alignment of fluid coupler 300 with a selected one of fluid couplers 262. For example, interface 267 may alternatively include a projection such as a locating pin while interface 263 includes a hole configured to receive the projection. Interfaces 263 and 267 may be configured to nest together. In alternative embodiments, interface 267 and 263 may have other structures configured to key to one another to ensure proper inter-engagement of interfaces 263 and 267 to facilitate alignment of coupler 300 with one of couplers 262.

Prongs 305 extend from body 301 and are configured to engage hooks 272 of interface 263. In the particular embodiment illustrated, prongs 305 include hooked portions configured to catch upon hooks 272. Prongs 305 resiliently flex as interfaces 267 and 263 are brought into engagement with one another. In alternative embodiments, hooks 272 may also or alternatively be configured to resiliently flex during engagement with prongs 305. Overall, hooks 272 and prongs 305 enable printhead assembly 234 to be quickly and easily coupled to interface 263 and support 226 or to be de-coupled from interface 263 and support 226 without fasteners and without tools.

Although interface 267 is illustrated as including prongs 305 while interface 263 is illustrated as including hooks 272, interface 267 may alternatively include hooks 272 while interface 263 includes prongs 305. In other embodiments, other retaining structures employing resiliently flexible members or employing spring biased catches, hooks or members may be employed to retain printhead assembly 234 to support 226 and to interface 263 without the need for fasteners or tool employing assembly. In yet other embodiments, printhead assembly 234 may be fastened to support 226 or interface 263 with tools and with fasteners.

Although interface 267 is illustrated as including passages 309 through which either fluid passages 92 or fluid coupler 300 extends towards interface 263, such passages 309 may be omitted, wherein passage 92 and coupler 300 are formed within or are embedded or encapsulated within body 301 of interface 267. Although interface 267 is illustrated as including a passage 309 corresponding to the number of fluid couplers 262 and the number of fluid conduits 54 of umbilical 232 to enable a single interface design to be utilized for all printhead assemblies employed with umbilical 232, each interface 267 may alternatively include only a single passage 309 for fluid coupler 300 and/or passage 92.

Signal-transmitting connector 290 is supported by interface 267 and is communicatively connected to each of printheads 84 by at least one signal-transmitting line 88 (shown in FIG. 1) within or on body 280. In particular embodiments, connector 290 may be additionally communicatively connected to driver such as driver 86 shown in FIG. 1.

Although the present invention has been described with reference to example embodiments, workers skilled in the art will recognize that changes may be made in form and detail without departing from the spirit and scope of the invention. For example, although different example embodiments may have been described as including one or more features providing one or more benefits, it is contemplated that the described features may be interchanged with one another or alternatively be combined with one another in the described example embodiments or in other alternative embodiments. Because the technology of the present invention is relatively complex, not all changes in the technology are foreseeable. The present invention described with reference to the example embodiments and set forth in the following claims is manifestly intended to be as broad as possible. For example, unless specifically otherwise noted, the claims reciting a single particular element also encompass a plurality of such particular elements.

What is claimed is:

1. A printing system comprising:

a first ink reservoir;

a support;

a first fluid conduit fluidly coupled to the ink reservoir and including a first fluid coupler; and a printhead assembly including:

a body releasably coupled to the support;

a plurality of printheads coupled to the body including a first printhead and a second printhead;

a fluid passage fluidly coupled to both the first printhead and the second printhead, the fluid passage including a second fluid coupler releasably coupled to the first fluid coupler.

2. The system of claim 1, wherein the plurality of printheads are releasably coupled to the body.

3. The system of claim 2, wherein the fluid passage includes a plurality of third fluid couplers and wherein the plurality of printheads includes a plurality of fourth fluid couplers releasably coupled to the third fluid couplers.

4. The system of claim 3, wherein at least one of the plurality of third fluid couplers and at least one of the plurality of fourth fluid couplers are keyed to one another.

5. The system of claim 1, wherein the first fluid coupler and the second fluid coupler are keyed to one another.

6. The system of claim 1 including:

a second ink reservoir; and an umbilical including the first fluid conduit, wherein the umbilical further includes:

a second fluid conduit fluidly coupled to the second ink reservoir and including a third fluid coupler.

7. The system of claim 6, wherein the third fluid coupler is configured to not fluidly couple to the second fluid coupler.

8. The system of claim 6, wherein the umbilical has a first interface stationarily coupled to the first fluid coupler and the third fluid coupler, wherein the printhead assembly includes a second interface stationarily coupled to the second fluid coupler and wherein the first interface and the second interface are keyed such that when the first interface is connected to the second interface, the first fluid coupler is aligned with the second fluid coupler.

9. The system of claim 8 including a controller, wherein the umbilical includes a first signal transmitting line connected to the controller and a first signal transmitting connector coupled to the signal transmitting line, wherein the printhead assembly includes:

a printhead driver;

a second signal transmitting line connected to the driver; and a second signal transmitting connector coupled to the second signal transmitting line, wherein the first connector is releasably connected to the second connector.

10. The system of claim 9, wherein the first interface of the umbilical and the second interface of the printhead assembly are keyed to align the first connector with the second connector during connection of the first interface to the second interface.

11. The system of claim 9 including a sheath containing the first fluid conduit and the second fluid conduit.

12. The system of claim 11, wherein the sheath further contains the at least one signal transmitting line.

13. The system of claim 12, wherein the at least one signal transmitting line is releasably coupled to the controller.

14. The system of claim 13, wherein the first fluid conduit and the second fluid conduit are releasably coupled to the first reservoir and the second reservoir, respectively.

15. The system of claim 9, wherein the at least one signal transmitting line is releasably coupled to the controller.

16. The system of claim 15, wherein the first fluid conduit and the second fluid conduit are releasably coupled to the first reservoir and the second reservoir, respectively.

17. The system of claim 1, wherein the plurality of printheads are staggered relative to one another.

18. The system of claim 1, wherein at least one of the first fluid coupler and the second fluid coupler is configured to block flow of fluid when in a disconnected state.

19. A printer kit comprising:

a printer including:

a first ink reservoir;

a second ink reservoir;

a support;

a first fluid conduit fluidly coupled to the first ink reservoir and including a first fluid coupler;

a second fluid conduit fluidly coupled to the second ink reservoir and including a second fluid coupler;

a first printhead assembly including:

a first body configured to be releasably coupled to the support;

a first plurality of printheads coupled to the first body including a first printhead and a second printhead;

a first fluid passage fluidly coupled to both the first printhead and the second printhead; and a third fluid coupler fluidly coupled to the first fluid passage, wherein the third fluid coupler is configured to connect to the first fluid coupler; and a second printhead assembly including:

a second body configured to be releasably coupled to the support;

a second plurality of printheads coupled to the second body including a third printhead and a fourth printhead;

a second fluid passage fluidly coupled to both the third printhead and the fourth printhead; and a fourth fluid coupler fluidly coupled to the second fluid passage, wherein the fourth fluid coupler is configured to connect to the second fluid coupler.

20. The kit of claim 19, wherein the first fluid passage is primed with a first ink and wherein the second fluid passage is primed with a second ink distinct from the first ink.

21. The kit of claim 19, wherein the first fluid conduit is primed with a first ink and wherein the second fluid conduit is primed with a second ink distinct from the first ink.

22. The kit of claim 19, wherein the plurality of printheads are releasably coupled to the body.

23. The kit of claim 22, wherein the first fluid passage includes a plurality of fifth fluid couplers and wherein the plurality of printheads includes a plurality of sixth fluid couplers releasably coupled to the plurality of fifth fluid couplers.

24. The kit of claim 23, wherein at least one of the plurality of fifth fluid couplers and at least one of the plurality of sixth fluid couplers are keyed to one another.

25. The kit of claim 19, wherein the third fluid coupler and the fourth fluid coupler are keyed so as to connect to the first fluid coupler and the second fluid coupler, respectively, and such that the first fluid coupler cannot be connected to the fourth fluid coupler and such that the second fluid coupler cannot be connected to the third fluid coupler.

26. The kit of claim 19, wherein the first fluid coupler and the third fluid coupler each include indicia suggesting the connection of the first fluid coupler and the third fluid coupler and wherein the second fluid coupler and the fourth fluid coupler each include indicia distinct from the first indicia suggesting connection of the second fluid coupler and the fourth fluid coupler.

27. The kit of claim 26, wherein the first indicia includes at least one of the following: color, surface markings and external configurations.

28. The kit of claim 26, wherein the first ink reservoir contains a first ink, wherein the second ink reservoir contains a second ink distinct from the first ink, wherein the first indicia is selected based upon the first ink and wherein the second indicia is selected based upon the second ink.

29. The kit of claim 28, wherein the first ink has a first color, wherein the second ink has a second color, wherein the first indicia has substantially the first color and wherein the second indicia has substantially the second color.

30. The kit of claim 19, wherein the first printhead assembly includes a first interface coupled to the first body and coupled to the third fluid coupler, wherein the second printhead assembly includes a second interface coupled to the second body and coupled to the fourth fluid coupler, wherein the first fluid coupler and the second fluid coupler are supported by a third interface configured to connect to either the first interface or the second interface and wherein the first interface, the second interface and the third interface are configured such that connection of the third interface and the first interface aligns the first fluid coupler with the third fluid coupler and such that connection of the third interface and the second interface aligns the second fluid coupler with the fourth fluid coupler.

31. The kit of claim 30, wherein the first fluid conduit and the second fluid conduit are coupled to one another as a single unit.

32. The kit of claim 31, wherein the first fluid conduit and the second fluid conduit are releasably coupled to the first ink reservoir and the second ink reservoir, respectively.

33. The kit of claim 19, wherein the first printhead assembly includes:

a first pen driver coupled to the first body and connected to each of the first plurality of printheads; and a first signal transmitting connector coupled to the body and connected to the first pen driver;

wherein the second printhead assembly includes:

a second pen driver coupled to the second body and connected to each of the second plurality of printheads; and a second signal transmitting connector coupled to the body and connected to the second pen driver; and wherein the printer further includes:

a printhead controller;

a signal transmitting line extending from the printhead controller; and a third signal transmitting connector coupled to the signal transmitting line, wherein the third signal transmitting connector is configured to be releasably connected to either the first signal transmitting connector or the second signal transmitting connector.

34. The kit of claim 33 including a fourth signal transmitting connector connected to the signal transmitting line, wherein the fourth signal transmitting connector is configured to be releasably coupled to the printhead controller.

35. The kit of claim 34, wherein the first fluid conduit and the second fluid conduit are configured to be releasably coupled to the first reservoir and the second reservoir, respectively, and wherein the first fluid conduit, the second fluid conduit and the signal transmitting line are coupled to one another as a single unit.

36. The kit of claim 35, wherein the first printhead assembly includes a first interface supporting the third fluid coupler, wherein the second printhead assembly includes a second interface supporting the fourth fluid coupler and wherein the printer includes a third interface supporting the first fluid coupler, the second fluid coupler and the third signal transmitting connector, wherein the first interface, the second interface and the third interface are configured such that connection of the first interface and the third interface aligns the first fluid coupler with the third fluid coupler and further aligns the first signal transmitting connector with the third signal transmitting connector, and such that connection of the second interface and the third interface aligns the second fluid coupler with the fourth fluid coupler and further aligns the second signal transmitting connector with the third signal transmitting connector.

37. The kit of claim 19 further including:

a third ink reservoir;

a third printhead assembly including:

a third body configured to be releasably coupled to the support;

a third plurality of printheads coupled to the third body;

a third fluid passage fluidly coupled to each of the plurality of printheads; and a fifth fluid coupler fluidly coupled to the third fluid passage; and a third fluid conduit fluidly coupled to the third ink reservoir and including a sixth fluid coupler configured to be releasably coupled to the fifth fluid coupler.

38. The kit of claim 37, wherein the third fluid conduit is releasably coupled to the third ink reservoir.

39. The kit of claim 19, wherein at least of the first fluid coupler, the second fluid coupler and the third coupler is configured to automatically block flow of fluid when in a disconnected state.

40. A printhead assembly for use in a printing system having an ink reservoir, a first fluid conduit fluidly coupled to the ink reservoir and including a first fluid coupler and a support adapted to be positioned proximate to a print medium, the printhead assembly comprising:

a body configured to be releasably coupled to the support;

a plurality of printheads coupled to the body including a first printhead and a second printhead;

a fluid passage fluidly coupled to both the first printhead and the second printhead; and a second fluid coupler fluidly coupled to the fluid passage and configured to be releasably coupled to the first fluid coupler.

41. The printhead assembly of claim 40, wherein the plurality of printheads are releasably coupled to the body.

42. The printhead assembly of claim 41, wherein the first fluid passage includes a third fluid coupler and wherein each of the plurality of printheads includes a fourth fluid coupler releasably coupled to the third fluid coupler.

43. The printhead assembly of claim 42, wherein the third fluid coupler and the fourth fluid coupler are keyed to one another.

44. The printhead assembly of claim 40, wherein the second fluid coupler is configured to be keyed to the first fluid coupler.

45. The printhead assembly of claim 40, wherein the first fluid coupler includes a first indicia and wherein the second fluid coupler includes a second indicia associated with the first indicia to suggest connection of the first fluid coupler with the second fluid coupler.

46. The printhead assembly of claim 40, wherein the printing system includes a second ink reservoir, a second fluid conduit fluidly coupled to the second ink reservoir and a third fluid coupler fluidly coupled to the second fluid conduit, and a first interface coupled to the first fluid coupler and the third fluid coupler, wherein the printhead assembly includes a second interface coupled to the first fluid coupler, wherein the first interface and the second interface are configured such that connection of the first interface to the second interface aligns the first fluid coupler with the second fluid coupler.

47. The printhead assembly of claim 46 including a first interface coupled to the body and coupled to the second fluid coupler and the signal transmitting connector, wherein the first interface is configured to mate with a second interface coupled to the first fluid coupler and a second signal transmitting connector communicatively coupled to the printhead controller.

48. The printhead assembly of claim 40 including:

a pen driver configured to control each of the plurality of printheads; and signal transmitting connector supported by, the body and communicatively coupled to the driver, wherein the connector is configured to releasably and communicatively connect the driver to a printhead controller.

49. The printhead assembly of claim 48, wherein the first interface and the second interface are configured such that the connection of the first interface and the second interface aligns the second fluid coupler with the first, fluid coupler and aligns the first signal transmitting connector with the second signal transmitting connector.

50. The printhead assembly of claim 40, wherein the plurality of printheads are staggered relative to one another.

51. An umbilical for use in a printing system including a plurality of ink reservoirs, a support adapted to be positioned proximate a print medium, a printhead assembly having a plurality of printheads coupled to the support including a first printhead and a second printhead, a fluid passage coupled to both the first printhead and the second printhead, a first fluid coupler fluidly coupled to the fluid passage, a printhead driver coupled to the support and communicatively coupled to a first signal transmitting connector, and printhead controller having a second signal transmitting connector, the umbilical comprising:

a plurality of fluid conduits, each fluid conduit having a second fluid coupler at a first end and a third fluid coupler at a second end, wherein at least one of the second fluid couplers is configured to be connected to the first fluid coupler and wherein each of the third fluid couplers is configured to be releasably coupled to one of the plurality of ink reservoirs; and a signal transmitting line having a third signal transmitting connector at a first end and a fourth signal transmitting connector at a second end, wherein the third signal transmitting connector is configured to be releasably connected to the first signal transmitting connector of the printhead assembly, wherein the fourth signal transmitting connector is configured to be releasably connected to the second signal transmitting connector of the printhead controller, and wherein the plurality of fluid conduits and the electrical transmission line are coupled to one another as a single unit.

52. The umbilical of claim 51, wherein only one of the second fluid couplers is configured to be connected to the first fluid coupler.

53. The umbilical of claim 51, wherein each second fluid coupler includes at least one indicia suggesting connection to a distinct fluid coupler associated with distinct printhead assemblies.

54. The umbilical of claim 53, wherein the indicia include at least one of the following: distinct colors, distinct surface markings and distinct external configurations.

55. The umbilical of claim 51, wherein the printhead assembly has a first interface supporting the first fluid coupler and wherein the umbilical has a second interface supporting each of the second fluid couplers, wherein the second interface is configured to align one of the second fluid couplers with the first fluid coupler when the second interface is connected to the first interface.

56. A method for printing different inks upon a print medium, the method comprising:

transmitting a first ink from a first ink reservoir through a first fluid conduit to a first plurality of printheads coupled to a body supported by a support proximate the medium;

disconnecting the first body from the support and from the first fluid conduit;

connecting a second body having a second plurality of printheads to the support and to a second fluid conduit; and transmitting a second ink from a second ink reservoir through the second fluid conduit to the second plurality of printheads.

* * * * *

UNITED STATES PATENT AND TRADEMARK OFFICE

CERTIFICATE OF CORRECTION

PATENT NO. : 7,066,572 B2
APPLICATION NO. : 10/699893
DATED : June 27, 2006
INVENTOR(S) : Mark McGarry et al.

It is certified that error appears in the above-identified patent and that said Letters Patent is hereby corrected as shown below:

In column 4, line 24, delete “6Q” and insert -- 60 --, therefor.

In column 12, line 45, delete “FIG. 11” and insert -- FIG. 1 --, therefor.

In column 19, line 58, in Claim 48, after “supported” delete “by,” and insert -- by --, therefor.

In column 19, line 65, in Claim 49, delete “first,” and insert -- first --, therefor.

Signed and Sealed this

Tenth Day of March, 2009

JOHN DOLL
*Acting Director of the United States Patent and Trademark Office*